US007832483B2

(12) United States Patent
Trent

(10) Patent No.: US 7,832,483 B2
(45) Date of Patent: Nov. 16, 2010

(54) METHODS OF RECOVERING HYDROCARBONS FROM OIL SHALE AND SUB-SURFACE OIL SHALE RECOVERY ARRANGEMENTS FOR RECOVERING HYDROCARBONS FROM OIL SHALE

(75) Inventor: Robert H. Trent, Scottsdale, AZ (US)

(73) Assignee: New Era Petroleum, LLC., Sheridan, WY (US)

( * ) Notice: Subject to any disclaimer, the term of this patent is extended or adjusted under 35 U.S.C. 154(b) by 186 days.

(21) Appl. No.: 12/018,594

(22) Filed: Jan. 23, 2008

(65) Prior Publication Data

US 2009/0183872 A1 Jul. 23, 2009

(51) Int. Cl.
*E21B 43/24* (2006.01)

(52) U.S. Cl. ..... 166/302; 166/57; 166/265

(58) Field of Classification Search ..... 166/247, 166/248, 302, 57; 299/2; 405/56, 130, 131; 392/301, 302, 303; 210/768
See application file for complete search history.

(56) References Cited

U.S. PATENT DOCUMENTS 1,634,236 A 6/1907 Ranney
1,520,737 A * 12/1924 Wright ..... 166/265
1,634,235 A 6/1927 Ranney
1,660,818 A 2/1928 Ranney
1,667,269 A 4/1928 Ranney
1,722,679 A 7/1929 Ranney
1,811,560 A 6/1931 Ranney
1,811,561 A 6/1931 Ranney
1,812,305 A 6/1931 Ranney
1,842,098 A 1/1932 Howard
1,851,446 A 3/1932 Ranney
1,858,847 A 5/1932 Young
1,870,869 A * 8/1932 Ranney et al. ..... 299/2
1,877,915 A 9/1932 Lewis
1,884,858 A 10/1932 Ranney
1,935,643 A 11/1933 Laughlin
2,331,072 A 10/1943 Hansen et al.
2,850,271 A 9/1958 Dykstra
2,989,294 A 6/1961 Coker (Continued)

OTHER PUBLICATIONS

Bartis et al., "Oil Shale Development in the United States", RAND Infrastructure, Safety, and Environment, pp. 1-61, 2005.

(Continued)

*Primary Examiner*—Daniel P Stephenson
*Assistant Examiner*—Blake Michener
(74) *Attorney, Agent, or Firm*—Wells St. John P.S.

(57) ABSTRACT

This invention includes methods of recovering hydrocarbons from oil shale, and sub-surface oil shale recovery arrangements for recovering hydrocarbons from oil shale. In one implementation, a sub-surface oil shale recovery arrangement for recovering hydrocarbons from oil shale includes a bore hole extending upwardly from a subterranean room into oil shale, with at least an upper part of the room being received within the oil shale and includes a wall through which the bore hole extends. The bore hole includes a lowest portion within the oil shale and an upper portion within the oil shale. A heating energy source extends from the subterranean room into the bore hole along the lowest portion and along the upper portion, insulation and/or cooling is received radially about the heating energy source extending along the lowest portion. Other aspects are contemplated.

34 Claims, 5 Drawing Sheets

U.S. PATENT DOCUMENTS

| | | | | | |
|---|---|---|---|---|---|
| 3,438,442 | A | * | 4/1969 | Pryor et al. | 166/303 |
| 3,598,182 | A | * | 8/1971 | Justheim | 376/275 |
| 3,749,170 | A | | 7/1973 | Riehl | |
| 3,785,402 | A | | 1/1974 | Collier | |
| 3,820,605 | A | | 6/1974 | Barber et al. | |
| 3,866,697 | A | | 2/1975 | Rossfelder et al. | |
| 3,878,312 | A | * | 4/1975 | Bergh et al. | 174/9 F |
| 3,882,937 | A | * | 5/1975 | Robinson | 166/267 |
| 3,934,935 | A | | 1/1976 | Lambly et al. | |
| 3,954,140 | A | * | 5/1976 | Hendrick | 166/50 |
| 4,008,762 | A | * | 2/1977 | Fisher et al. | 166/248 |
| 4,020,901 | A | * | 5/1977 | Pisio et al. | 166/50 |
| 4,047,760 | A | | 9/1977 | Ridley | |
| 4,061,190 | A | | 12/1977 | Bloomfield | |
| 4,099,570 | A | * | 7/1978 | Vandergrift | 166/303 |
| 4,101,172 | A | | 7/1978 | Rabbitts | |
| 4,113,626 | A | * | 9/1978 | Detcher | 210/409 |
| 4,140,180 | A | | 2/1979 | Bridges et al. | |
| 4,144,935 | A | | 3/1979 | Bridges et al. | |
| 4,160,481 | A | * | 7/1979 | Turk et al. | 166/272.3 |
| 4,165,903 | A | | 8/1979 | Cobbs | |
| 4,201,420 | A | * | 5/1980 | Likholai et al. | 299/2 |
| 4,283,088 | A | | 8/1981 | Tabakov et al. | |
| 4,296,969 | A | * | 10/1981 | Willman | 299/2 |
| 4,332,401 | A | * | 6/1982 | Stephenson et al. | 285/47 |
| 4,378,949 | A | | 4/1983 | Miller | |
| 4,381,124 | A | | 4/1983 | Verty et al. | |
| 4,401,163 | A | | 8/1983 | Elkins | |
| 4,423,907 | A | | 1/1984 | Ridley | |
| 4,441,759 | A | | 4/1984 | Hutchins et al. | |
| 4,444,433 | A | | 4/1984 | Ricketts | |
| 4,458,757 | A | | 7/1984 | Bock et al. | |
| 4,458,945 | A | * | 7/1984 | Ayler et al. | 299/2 |
| 4,463,987 | A | | 8/1984 | Berg et al. | |
| 4,463,988 | A | * | 8/1984 | Bouck et al. | 299/2 |
| 4,483,398 | A | | 11/1984 | Peters et al. | |
| 4,502,733 | A | * | 3/1985 | Grubb | 299/2 |
| 4,508,168 | A | | 4/1985 | Heeren | |
| 4,524,826 | A | | 6/1985 | Savage | |
| 4,595,239 | A | | 6/1986 | Ayler et al. | |
| 4,607,888 | A | | 8/1986 | Trent et al. | |
| 4,674,922 | A | * | 6/1987 | Federhen et al. | 406/126 |
| 4,693,313 | A | | 9/1987 | Stephenson et al. | |
| 4,811,741 | A | | 3/1989 | Shell et al. | |
| 4,928,765 | A | | 5/1990 | Nielson | |
| 5,040,601 | A | | 8/1991 | Karlsson et al. | |
| 5,082,054 | A | | 1/1992 | Kiamanesh | |
| 5,255,742 | A | * | 10/1993 | Mikus | 166/303 |
| 5,547,021 | A | | 8/1996 | Raden | |
| 5,655,852 | A | | 8/1997 | Duffney et al. | |
| 6,149,345 | A | | 11/2000 | Atkins | |
| 6,561,041 | B1 | | 5/2003 | Eck | |
| 7,093,661 | B2 | | 8/2006 | Olsen | |
| 2003/0089506 | A1 | | 5/2003 | Ayler et al. | |
| 2005/0103497 | A1 | * | 5/2005 | Gondouin | 166/302 |
| 2006/0290197 | A1 | | 12/2006 | See et al. | |
| 2007/0012450 | A1 | | 1/2007 | Uttley | |
| 2009/0173488 | A1 | * | 7/2009 | Varma | 166/60 |

OTHER PUBLICATIONS

U.S. Appl. No. 11/649,483, filed Jan. 4, 2007, Richter et al.
U.S. Appl. No. 11/652,908, filed Jan. 11, 2007, Richter et al.
Best et al., Underground Test Facility: Shaft and Tunnel Laboratory for Horizontal . . . , Society of Petroleum Engineers, 60th Annual Tech. Conf. and Exhibit, SPE 14333, 16 pages (Las Vegas, NV Sep. 22-25, 1985).
Cowan, 1928-1985: The Devran Gravity Assisted Drainage of Petroleum Project, Geology-Devonian, vol. 24, No. 12, Ontario Petroleum Institute Conference and Trade Show, pp. 1-7 (1986).
Dick et al., Oil Mining, 5 pages (pre-2006).
Lyman et al., Heavy Oil Mining Technical and Economic Analysis, Society of Petroleum Engineers, California Regional Meeting, SPE 12788, pp. 565-574 (Long Beach, CA Apr. 11-13, 1984).
Publication of TAM International titled, "Horizontal Jet Pump Testing with Jet Pump in Lateral," http://www.tamintl.com/pages/tech3j.htm, printed May 13, 2005, 1 pg.
Publication of TAM International titled, "Locating and Controlling Water Production in Horizontal Wells (Permian Basin)," http://www.tamintl.com/pages/tech3.htm, printed Oct. 27, 2006, 6 pgs.
Publication of TAM International titled, "McElroy Field Horizontal Well Case History No. 1, Crier McElroy 147, Fluid Entry Evaluation and Water Shut-off," http://www.tamintl.com/pages/tech3c.htm, printed Oct. 27, 2006, 1 pg.
Publication of TAM International titled, "McElroy Field Typical Horizontal Well Application (Figure 1), "http://www.tamintl.com/pages/tech3b.htm, printed Sep. 15, 2006, 1 pg.
Publication of TAM International titled, "Scab Liner and Bridge Plug," http://www.tamintl.com/pages/tech3g.htm, printed May 13, 2005, 1 pg.
Ranney, Horizontal Wells Are All in Pay—and Flow by Gravity, The Petroleum Engineer, pp. 127-130 (Aug. 1941).
Rice, Mining Petroleum by Underground Methods: A Study of Methods Used in France and Germany and Possible . . . , U.S. Department of Commerce, Bureau of Mines, Bulleting 351, pp. Title-159 (1932).
Stephenson, Underground mining and tunneling techniques for in-situ oil recovery, Tunnels & Tunnelling, pp. 41-46 (Sep. 1988).
Streeter et al., Recovery of Oil From Underground Drillsites, Society of Petroleum Engineers, Eastern Regional Meeting, SPE 19344, pp. 339-348 (Morgantown, WV Oct. 24-27, 1989).
See, Mark, "Oil mining field test to start in East Texas", Gulf Publishing Company, 1996, reprinted from the Nov. 1996 issue of World Oil Magazine.
WO, IB08/001857, Apr. 27, 2009, Search Report.
WO, IB08/001857, Apr. 27, 2009, Written Opinion.
WO, PCT/US2007/025696, May 9, 2008, Written Opinion.
WO, PCT/US2007/025696, May 9, 2008, Search Report.
WO, PCT/US2007/025698, May 9, 2008, Written Opinion.
WO, PCT/US2007/025698, May 9, 2008, Search Report.
WO, PCT/US2009/031382, Aug. 31, 2009, Written Opinion.
WO, PCT/US2009/031382, Aug. 31, 2009, Search Report.
WO, WO2002-086018, Oct. 31, 2002, Shell Oil Company.

* cited by examiner

METHODS OF RECOVERING HYDROCARBONS FROM OIL SHALE AND SUB-SURFACE OIL SHALE RECOVERY ARRANGEMENTS FOR RECOVERING HYDROCARBONS FROM OIL SHALE

TECHNICAL FIELD

This invention relates to methods of recovering hydrocarbons from oil shale and to sub-surface oil shale recovery arrangements for recovering hydrocarbons from oil shale.

BACKGROUND OF THE INVENTION

Oil shale is a sedimentary formation having layers containing an organic polymer called kerogen which upon heating decomposes to produce hydrocarbon liquid and gaseous products. Known methods for heating oil shale include extending heating devices downwardly into the oil shale from above the earth's surface to cause liquid and gas to separate from solid material, and which are then pumped to the surface. Further, many in situ retorting techniques have been reported wherein the oil shale itself is fractured and ignited to provide the heating energy source to cause liquid and gas separation from surrounding solid material.

Needs remain for improved techniques and arrangements for recovering hydrocarbons from oil shale.

While the invention was motivated in addressing the above identified issues, it is in no way so limited. The invention is only limited by the accompanying claims as literally worded, without interpretative or other limiting reference to the specification, and in accordance with the doctrine of equivalents.

SUMMARY

This invention includes methods of recovering hydrocarbons from oil shale, and sub-surface oil shale recovery arrangements for recovering hydrocarbons from oil shale. In one implementation, a method of recovering hydrocarbons from oil shale includes providing a bore hole extending upwardly from a subterranean room into oil shale. At least an upper part of the room is received within the oil shale and comprises a wall through which the bore hole extends. The bore hole comprises a lowest portion within the oil shale and an upper portion within the oil shale. A heating energy source is provided within the bore hole from the subterranean room. The heating energy source extends along the lowest portion and along the upper portion. Insulation is received radially about the heating energy source extending along the lowest portion. An effective power is applied to the heating energy source within the bore hole to cause liquid hydrocarbons to be extracted from solids within the oil shale externally of the upper portion of the bore hole. The liquid hydrocarbons enter the bore hole upper portion and flow downwardly into the bore hole lowest portion about and along the heating energy source and into the subterranean room. The insulation received radially about the heating energy source in the lowest portion of the bore hole is sufficient to restrict liquid hydrocarbons from separating from the oil shale at the wall of the subterranean room upon application of said effective power.

In one implementation, a method of recovering hydrocarbons from oil shale includes providing a bore hole extending upwardly from a subterranean room into oil shale. At least an upper part of the room is received within the oil shale and comprises a wall through which the bore hole extends. The bore hole comprises a lowest portion within the oil shale and an upper portion within the oil shale. A heating energy source is provided within the bore hole from the subterranean room. The heating energy source extends along the lowest portion and along the upper portion. A cooling energy source extends from the subterranean room radially about the heating energy source extending along the lowest portion. An effective power is applied to the heating energy source within the bore hole to cause liquid hydrocarbons to be extracted from solids within the oil shale externally of the upper portion of the bore hole. The liquid hydrocarbons enter the bore hole upper portion and flow downwardly into the bore hole lowest portion about and along the heating energy source and into the subterranean room. While applying said effective power to the heating energy source, an effective power is applied to the cooling energy source in the lowest portion of the bore hole to restrict liquid hydrocarbons from separating from the oil shale at the wall of the subterranean room from application of said effective power to the heating source.

In one implementation, a method of recovering hydrocarbons from oil shale includes providing a bore hole extending upwardly from a subterranean room into oil shale. A heating energy source is provided within the bore hole from the subterranean room. An effective power is applied to the heating energy source within the bore hole to cause liquid hydrocarbons to be extracted from solids within the oil shale externally of the bore hole. The liquid hydrocarbons along with solids from the oil shale enter the bore hole and flow downwardly along the heating energy source and into the subterranean room. Within the subterranean room, liquid hydrocarbons are separated from the solids by flowing the solids to a solids collector. The solids collector comprises an upper volume and a lower volume. The upper and lower volumes are separated by an upper valve. The lower volume comprises a lower valve. The flowing of solids to the solids collector comprises collecting a volume of solids within the lower volume of the solids collector. A volume of solids is collected within the upper volume of the solids collector with the upper valve at least partially closed. While collecting a volume of solids within the upper volume with the upper valve at least partially closed, the volume of solids within the lower volume is discharged therefrom through the lower valve.

Other aspects and implementations are contemplated.

BRIEF DESCRIPTION OF THE DRAWINGS

Preferred embodiments of the invention are described below with reference to the following accompanying drawings.

DETAILED DESCRIPTION OF THE PREFERRED EMBODIMENTS

This disclosure of the invention is submitted in furtherance of the constitutional purposes of the U.S. Patent Laws "to promote the progress of science and useful arts" (Article 1, Section 8).

Figure 1:
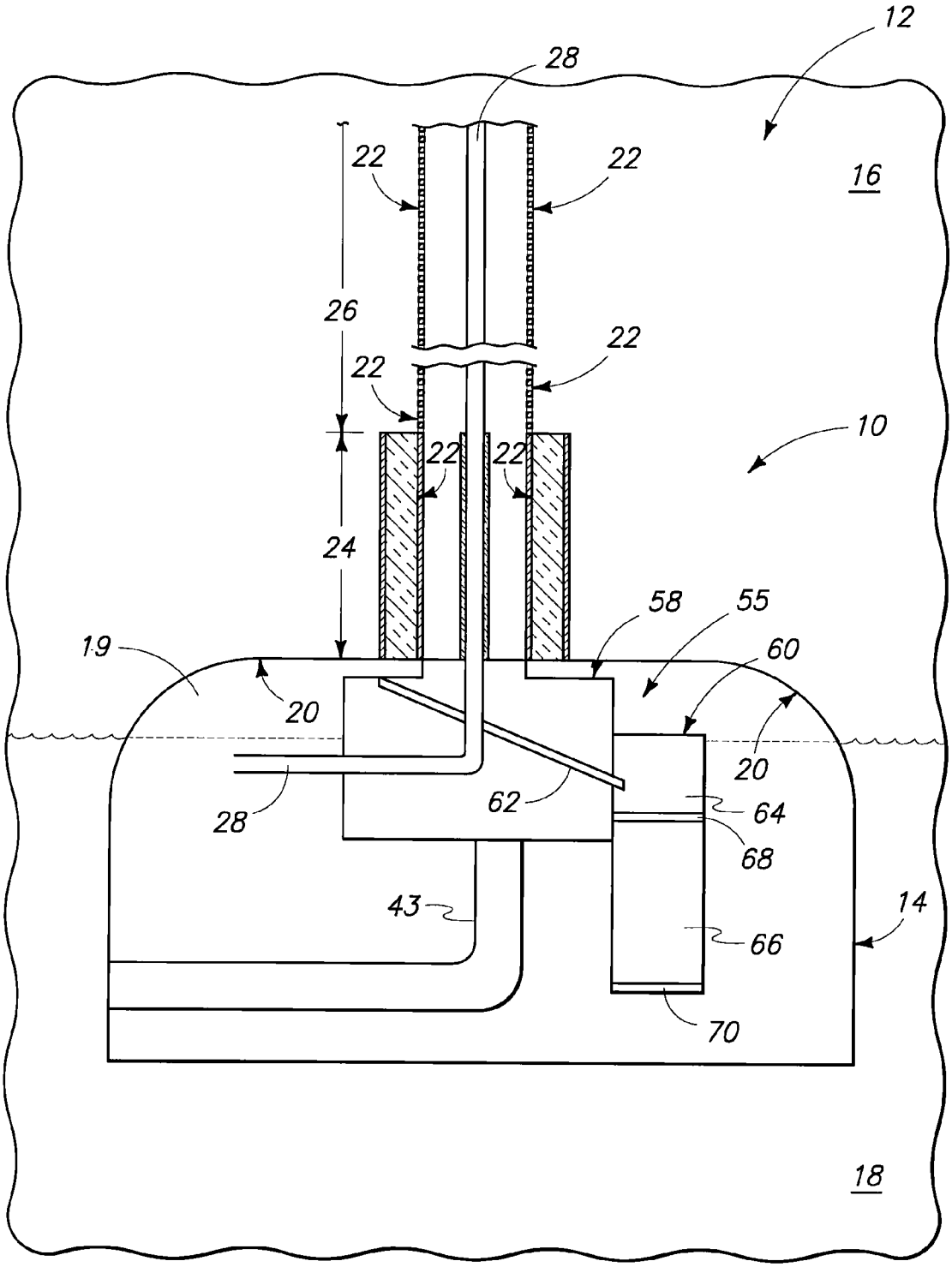
FIG. 1 is a diagrammatic representation of a sub-surface oil shale recovery arrangement for recovering hydrocarbons from oil shale in accordance with some aspects of the invention.

Referring initially to FIG. 1, an example sub-surface oil shale recovery arrangement for recovering hydrocarbons from oil shale is indicated generally with reference 10. FIG. 1 depicts earthen material 12 and a subterranean room 14 received therein. A mine shaft or drift (not shown) would typically connect with subterranean room 14 and ultimately extend to the surface. Earthen material 12 is shown as comprising a stratum of oil shale 16 and a stratum 18 therebelow comprising material other than oil shale. In the FIG. 1 embodiment, at least an upper part 19 of room 14 is received within oil shale 16. In some embodiments, for example as shown in FIG. 1, only a part of subterranean room 14 is received within the stratum bearing oil shale. In other embodiments, all of the subterranean room is received within the oil shale stratum. Still in further embodiments, none of the subterranean room might be received within oil shale-bearing stratum, with such room being received one or both of laterally thereof or therebelow. In FIG. 1, upper part 19 of subterranean room 14 comprises a wall 20 which is received within oil shale 16. In the depicted example, wall 20 comprises a roof of subterranean room 14.

Figure 2:
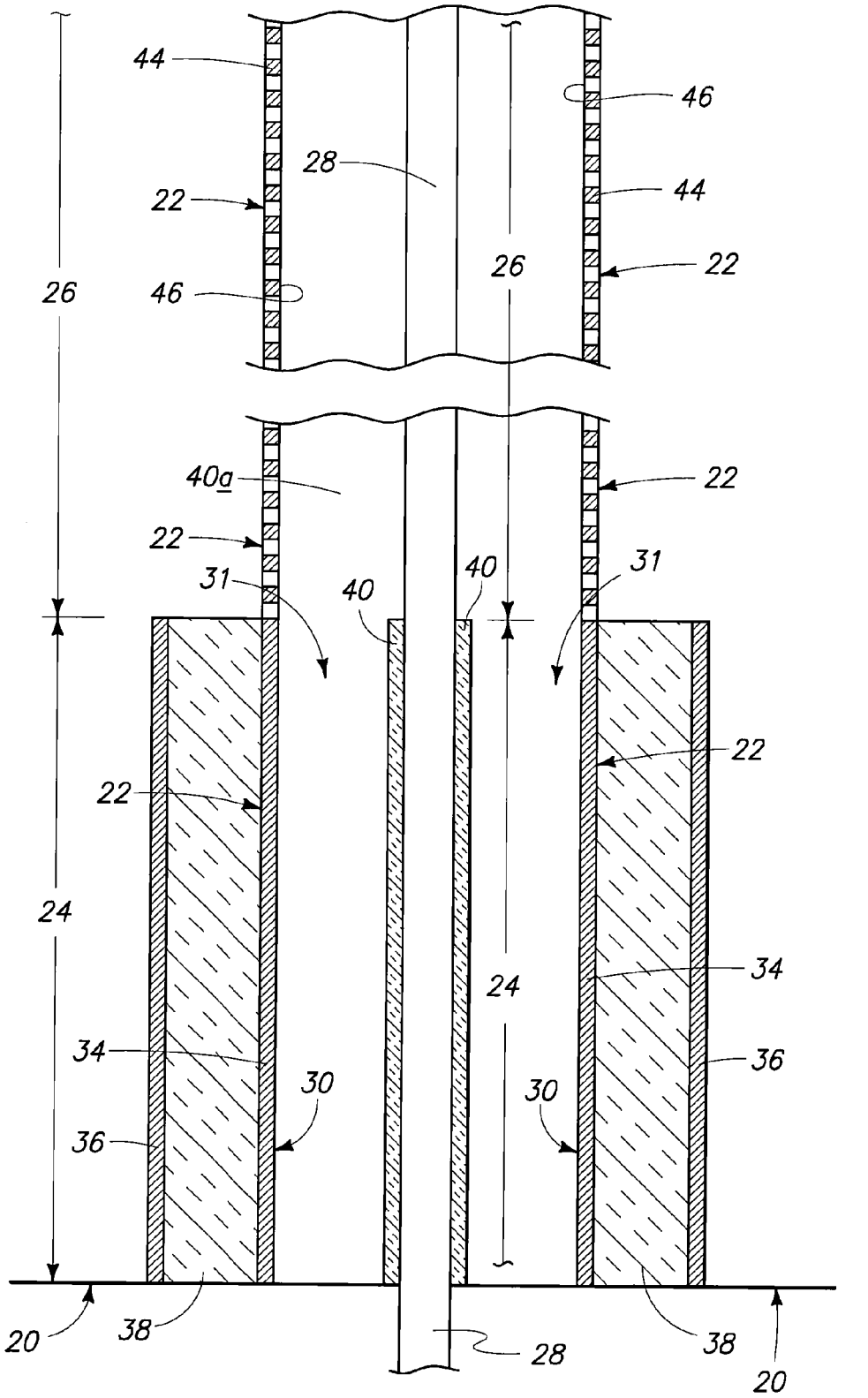
FIG. 2 is an enlarged view of a portion of FIG. 1.

Referring to FIGS. 1 and 2, a bore hole 22 is diagrammatically depicted as extending upwardly from subterranean room 14 through wall 20 into oil shale 16. FIGS. 1 and 2 depict bore hole 22 as extending vertically upward into oil shale 16. Alternately by way of example only, such might be angled upwardly into oil shale 16 at some angle other than vertical, extend into oil shale 16 at multiple different angles, and/or serpentine upwardly into oil shale 16 along one or more straight and/or curved paths. Recovery of hydrocarbons from the oil shale will at least, in part, occur by gravity from bore hole 22 extending upwardly to at least some degree within oil shale 16. Further, bore hole 22 is shown as extending upwardly through wall 20 which comprises a roof of subterranean room 14. Alternately by way of example only, bore hole 22 might extend upwardly into oil shale 16 from a side or other wall of subterranean room 14.

FIG. 1 for simplicity and ease of depiction shows a single bore hole 22 provided relative to subterranean room 14. However, the drawing is not to scale regarding height and breadth of the room relative to dimensions of bore hole 22 and, as will be appreciated by the artisan, more likely a dozen or more bore holes will be provided into oil shale 16 from subterranean room 14. Further and regardless, individual bore holes extending from subterranean room may branch one or multiple times into sub-branches.

Bore hole 22 can be considered as comprising a lowest portion 24 within oil shale 16 and an upper portion 26 within oil shale 16. A heating energy source 28 extends from subterranean room 14 into bore hole 22, and extends along lowest portion 24 and upper portion 26 thereof. Heating energy source 28 is configured such that an effective power can be applied thereto within bore hole 22 to cause liquid hydrocarbons to be extracted from solids within oil shale 16 externally of upper portion 26 of bore hole 22. Such liquid hydrocarbons will enter into bore hole upper portion 26 and flow downwardly into bore hole lowest portion 24 about and along heating energy source 28 into subterranean room 14. Example heating sources include microwave energy emission, radio frequency energy emission, ultrasonic energy emission, megasonic energy emission, etc., to name a few. Further by way of examples only, the heating energy source 28 might comprise liquid and/or gas heating fluid emitted into oil shale 16 of a sufficient energy to effect liquid hydrocarbon extraction, and/or one or more closed-looped heating conduits. Further for example, if bore hole 22 was initially drilled to have branches extending therefrom, heating source 28 preferably extends at least partially into such branches.

The artisan will appreciate that heating energy source 28 must be capable of being sufficiently powered to heat the oil shale surrounding bore hole 22 to a suitable temperature in order to effect liquid hydrocarbon separation, and can size and configure heating energy source 28 appropriately therefore. For example, likely a temperature of at least 500° F. may be required. Further the greater the degree of heating, the greater will be the radial distance from bore hole 22 where liquid separation will occur and flow to upper portion 26 of bore hole 22. Nevertheless, since wall 20 through which bore hole 22 extends is received within oil shale 16, and heating energy source 28 will radiate heat energy into oil shale 16 in at least some part of lowest portion 24, it is possible and would be undesirable that liquid hydrocarbon from oil shale 16 would leach or fall into subterranean room 14 from wall 20. At "best", such would create a mess within subterranean room 14 and/or require collection of leaching liquid hydrocarbon from wall 20 proximate thereto. However, liquid hydrocarbon recovery from an oil shale by heating/pyrolysis typically also results in separation of at least some solid material with the liquid which could undermine the integrity of the walls of subterranean room 14 through which bore hole 22 extends. Such of course is not desired, and it would be desirable to eliminate, or at least restrict, liquid and solid separation from the oil shale from occurring at the wall or walls of the subterranean room through which respective bore holes 22 extend. In one embodiment, suitable insulation is received radially about the heating energy source where it extends along the lowest portion of the bore hole.

FIGS. 1 and 2 depict but one preferred embodiment in which such insulation is provided. Insulation received radially about the heating energy source in lowest portion 24 of bore hole 22 is provided to be sufficient to restrict liquid hydrocarbons from separating from oil shale 16 at wall 20 of subterranean room 14 upon application of such effective power. Ideally, the insulation will be of sufficient degree to eliminate any liquid hydrocarbon and any solid material associated therewith from separating from oil shale 16 at wall 20. Regardless, such insulation need at least be effective to restrict/reduce liquid hydrocarbon separation from oil shale 16 than would otherwise occur during continuous production of hydrocarbon recovery from oil shale 16 in the absence of such insulation.

Specifically, FIGS. 1 and 2 depict an example embodiment wherein lowest portion 24 of bore hole 22 comprises inner sidewalls 30 which define a fluid conduit 31 through which liquid hydrocarbons flow into subterranean room 14 and with which such liquid hydrocarbons come into contact during such flow into subterranean room 14. In the depicted embodiment, a lowest bore hole casing 34 is provided which defines lowest portion inner sidewalls 30. Such might be comprised of one or more different materials and/or layers, with one-half-inch to one-inch thick stainless steel being an example suitable casing 34.

The embodiment of FIGS. 1 and 2 is also depicted as comprising an external casing 36 which is received about lowest portion 24 of bore hole 22 radially outward of lowest bore hole casing 34. A first portion 38 of insulation material is received between lowest bore hole casing 34 and external casing 36. Any suitable one or more thermally insulative materials are contemplated, and whether existing or yet-to-be developed. By way of examples only, example materials include concrete-type foams which may or may not include ground-up ceramic, glass, and/or perlite, or other materials. Regardless, the example insulation material 38 in the depicted embodiment might be slid as a sleeve into the space within which such is received, or injected thereinto as a liquid and allowed to substantially solidify or cure into a solid or gel which may or may not retain some liquid phase. Alternately or additionally to that shown, insulation material might also be provided internally within fluid conduit 31 against inner sidewalls 30.

FIGS. 1 and 2 also depict a second portion 40 of insulation material received about heating energy source 28 radially inward of inner sidewalls 30. Such may comprise the same or different material as that of first portion of insulation 38 and be of the same or different radial thickness. Also preferably, heating energy source 28 where it enters into or extends from proximate wall 20 into subterranean room 14 will likely be suitably shielded or restricted (not shown) from applying such heating energy into room 14. By way of example only, such might occur by insulation, a cooling jacket, and/or other radiation shield received thereabout.

One or both of insulation portions 38 or 40 might be provided, or other insulation provided, in accordance with the above example preferred objectives of at least restricting liquid hydrocarbon from flowing into subterranean room 14 from roof/ceiling 20 than would otherwise occur in the absence of suitable insulation during continuous production. Regardless, in the FIGS. 1 and 2 embodiment at least some suitable insulation is received radially about the heating energy source extending along lowest portion 24 of bore hole 22. In one implementation, the insulation contacts the heating energy source. For example, insulation 40 is depicted as contacting heating energy source 28. In one implementation, insulation which is used is spaced from the heating energy source. For example, insulation 38 is spaced from and thereby not contacting heating energy source 28 within lowest portion 24 of bore hole 22. In one implementation, at least some of the insulation is received more proximate the inner sidewalls of the bore hole as compared to a radial center of the bore hole. For example, insulation 38 is an example of such insulation, and is also received externally of lowest portion inner sidewalls 30. Further in one example embodiment, at least some of the insulation is spaced radially inward from inner sidewalls 30. For example, insulation 40 is an example of such, and in the depicted embodiment where insulation 40 is received more proximate a radial center of bore hole 22 than to bore hole inner sidewalls 30, and also is contacting heating energy source 28.

Upper portion 26 of bore hole 22 might be entirely void of insulation, for example as is depicted in FIGS. 1 and 2. Further and regardless, upper portion 26 may or may not be partially or wholly provided with casing. Upper portion 26 of bore hole 22 is depicted as comprising an upper bore hole casing 44 which defines upper portion inner sidewalls 46 with which liquid hydrocarbons come into contact during flow into upper portion 26 and ultimately into subterranean room 14. Such casing is perforated as shown to allow at least liquid hydrocarbon to flow there-into. Alternately by way of examples only, upper portions of bore hole 22 might not include any casing to perhaps enable better flow of liquid and/or solid oil shale material within upper portion 26 of bore hole 22 the result of suitable heating with heating energy source 28. In the depicted embodiment, upper portion 26 of bore hole 22 is void of any external casing received radially outward of upper bore hole casing 44 unlike the external and lowest bore hole casing relationship in lowest bore hole portion 24.

Figure 3:
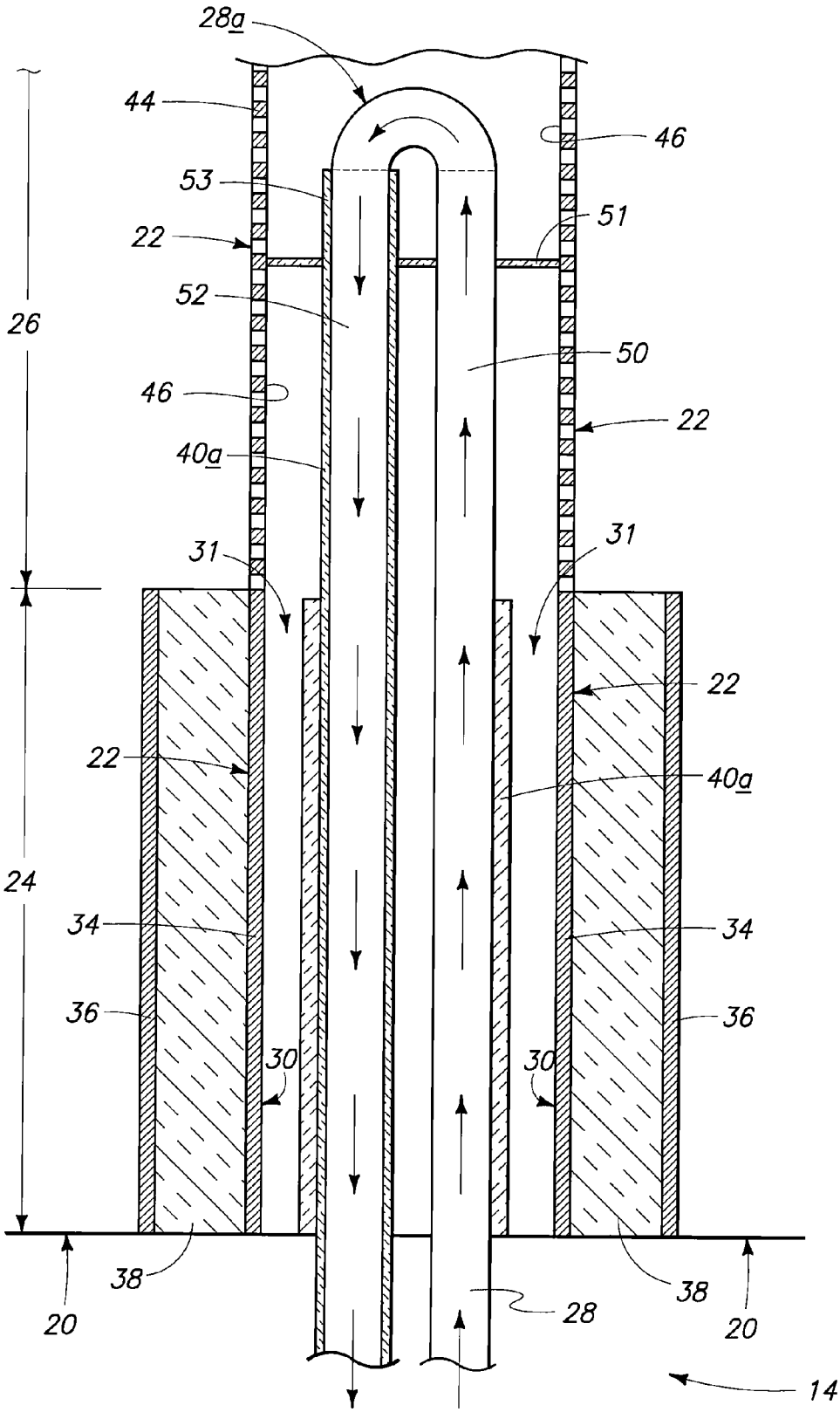
FIG. 3 is an alternate embodiment to that depicted in FIG. 2.

FIG. 3 illustrates an alternate example embodiment heating energy source arrangement 28*a*. Like numerals from the first described embodiment are utilized where appropriate, with differences being indicated with different numerals or the suffix "a". FIG. 3 depicts heating energy source 28*a* as comprising a closed loop system comprising a heat input line 50 and a heat discharge line 52. For example and by way of example only, heat input line 50 might comprise a steam input line, with line 52 comprising a condensate return line. A spacer member 51 is shown for radially supporting lines 50 and 52. Further by way of example only, conduit return line 52 is depicted as comprising an insulating jacket 53. Also, insulating jacket 40*a* in one example encircles both input steam line 50 and return line 52 within lowest portion 24 of bore hole 22.

A sub-surface oil shale recovery arrangement for recovering hydrocarbons from oil shale might additionally include equipment for collecting and/or distributing recovered hydrocarbons which flow into the subterranean room from which one or more bore holes extends. For example and referring again to FIG. 1, sub-surface oil shale recovery arrangement 10 is depicted as comprising exemplary such equipment 55. Such equipment in one example embodiment is configured to contend with solids which may enter bore hole upper portion 26 along with liquid hydrocarbons and which flow downwardly into bore hole lowest portion 24 about and along heating energy source 28 into subterranean room 14. For example, equipment 55 is diagrammatically shown as comprising some suitable liquid/solids separator 58 and a solids collector 60. In one example, separator 58 is shown as comprising a downwardly angled screen 62 through which liquid hydrocarbon would flow but ideally above which solids are retained. A conduit 43 discharges liquid hydrocarbon from separator 58 beneath screen 62 for collection and/or pumping to the surface. Solids would travel downwardly along screen 62 to solids collector 60. In the depicted embodiment, heating energy source 28 is shown as extending upwardly through downwardly angled screen 62 and into bore hole 22.

Solids collector 60 comprises an upper volume 64 and a lower volume 66. Such upper and lower volumes are separated by an upper valve 68. Lower volume 66 comprises a lower valve 70. Such embodiment provides but one example type of equipment by which solids might be collected ideally without halting or reducing production of liquid hydrocarbon through conduit 43. For example, a volume of solids is collected within lower volume 66 of solids collector 60. Such may occur by solids flowing along downwardly angled screen 62 to upper portion 64 of solids collector 60 and through a partially or wholly opened upper valve 68. At some point, lower volume 62 will fill sufficiently such that it is desired to expel solids therefrom. Such might occur by collecting a volume of solids within upper volume 64 with at least upper valve 68 at least partially closed. The volume of solids collected or collecting within lower volume 66 in such instance can be discharged from lower volume 66 through lower valve 70. Such can be collected and/or otherwise conveyed outwardly of subterranean room 14.

In one example embodiment, a volume of solids can be collected within lower volume 66 while upper valve 68 is open and lower valve 70 is closed. Thereafter, upper valve 68 is closed and a volume of solids is collected within upper volume 64. At some point during such time, lower valve 70 is opened and the volume of solids within lower volume 66 is expelled therefrom through lower valve 70 while upper valve 68 is closed.

Figure 4:
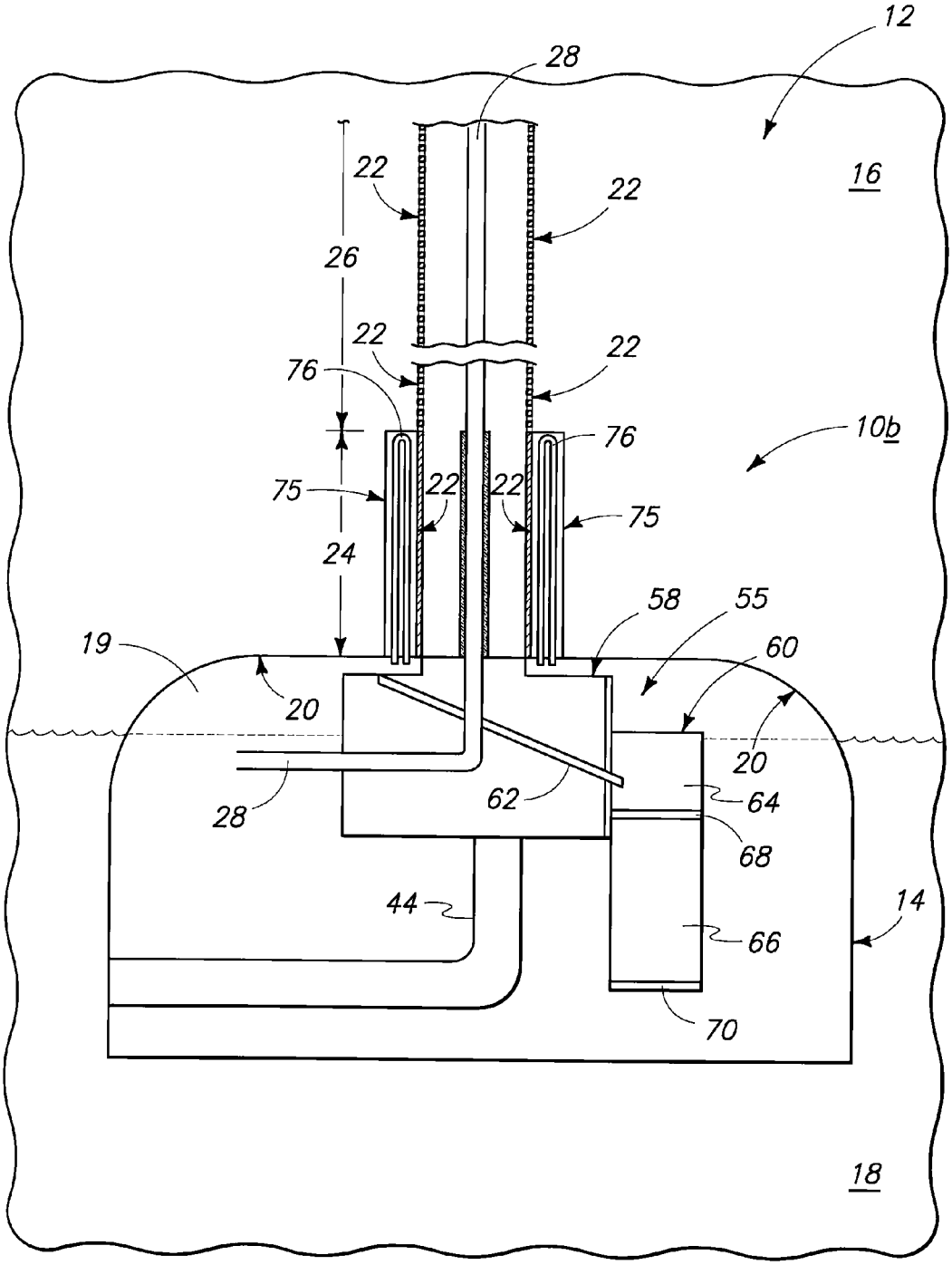
FIG. 4 is a diagrammatic representation of another sub-surface oil shale recovery arrangement for recovering hydrocarbons from oil shale in accordance with some aspects of the invention.
Figure 5:
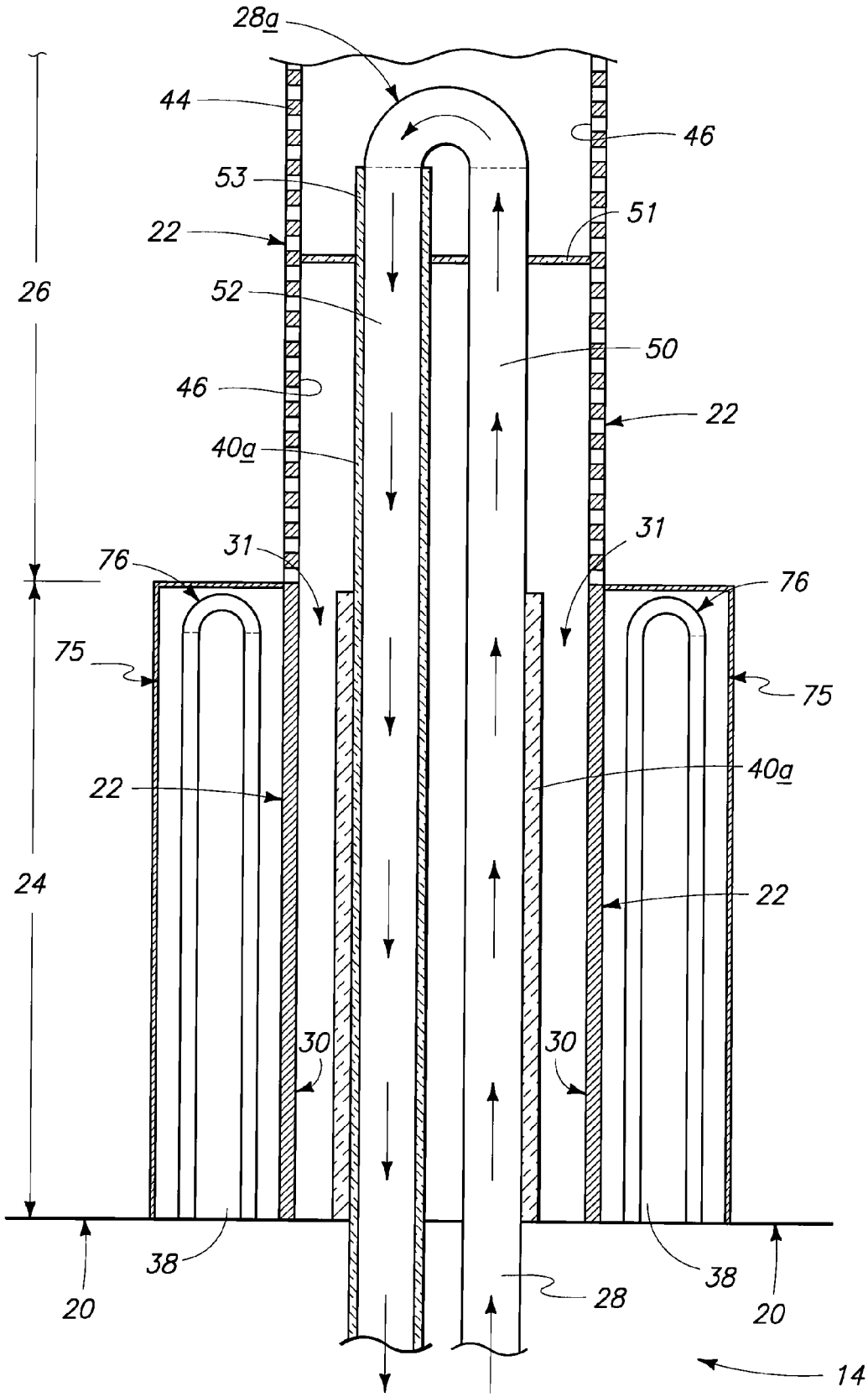
FIG. 5 is an enlarged view of a portion of FIG. 4.

An alternate embodiment sub-surface oil shale recovery arrangement for recovering hydrocarbons from oil shale is next described with reference to FIGS. 4 and 5, and indicated generally with reference numeral 10*b*. Like numerals from the first described embodiments are utilized where appropriate, with differences being indicated with different numerals or with the suffix "b". Arrangement 10*b* comprises a cooling energy source 75 which extends from subterranean room 14 to be received radially about heating energy source 28 extending along lowest portion 24 of bore hole 22. Cooling energy source 75 is sized and configured to be effectively powered within lowest bore hole portion 24 to restrict liquid hydrocarbons from separating from oil shale 16 at wall 20 of subterranean room 14 from application of an effective power to heating source 28 which causes liquid hydrocarbon extraction from solids within oil shale 16 externally of upper bore hole portion 26. Ideally, the cooling power will be of sufficient degree to eliminate any liquid hydrocarbon and any solid material associated therewith from separating from oil shale 16 at wall 20. Regardless, such cooling energy source need at least be effective to restrict/reduce liquid hydrocarbon separation from oil shale 16 than would otherwise occur in continuous production of hydrocarbon recovery from oil shale 16 in the absence of such insulation.

In one embodiment and as shown, cooling energy source 75 is received externally of bore hole 22 to be spaced from contacting liquid hydrocarbons which flow downwardly within the bore hole lowest portion 24 and into subterranean room 14. Accordingly and regardless, in one preferred embodiment the cooling energy source is received more proximate sidewalls of the lowest portion of the bore hole than a radially center of the lowest portion of the bore hole. In one embodiment and as shown, an example cooling energy source includes a plurality of closed-loop cooling conduits 76 which comprise cooling fluid therein, and which are received circumferentially about lowest bore hole portion 24. Other arrangements might of course be utilized. Further and regardless, cooling might additionally or alternately be provided within bore hole 22 proximate the bore hole walls.

Provision of a cooling energy source may or may not be combined with any of the above-described insulation aspects. For example and by way of example only, FIGS. 4 and 5 depict arrangement 10*b* as comprising insulation 40 which is received about heating energy source 28 in bore hole lowest portion 24 radially inward of the cooling energy source. Further additionally, the example insulation 38 encasing 36 of the above first described embodiment might be utilized in combination with the cooling energy source.

In any of the above embodiments, the length of the bore hole into the oil shale may be selected by the artisan to achieve desirable production of hydrocarbon from the oil shale. For example, the total length of bore hole 22 within oil shale 16 above subterranean room wall 20 might be 1,000 feet or more. Further by way of example only, example diameters for bore hole 22 might be anywhere from 0.5 foot to 4 feet. Larger diameters are also of course contemplated. Further, the length of lowest portion 24 within the oil shale above wall 20 can be optimized and selected depending upon one or a combination of the energy provided by the heating source, the effectiveness of any insulation provided radially thereabout including materials selected and annular thickness, and/or degree of the cooling capacity of any cooling energy source. By way of example only, it is expected that lower portion 24 might range anywhere from 25 to 75 feet within the oil shale 16 above wall 20. Lesser or greater lengths are also, of course, contemplated depending upon the above and other factors.

The example depicted bore hole 22 might be provided by any existing or yet-to-be developed manner. Further, such might be of substantially constant or of different diameters within the oil shale. For example and by way of example only, a raised bore drilling machine might be utilized to initially drill a bore hole upwardly at a certain diameter, and thereafter expanded by reamer arms to be a great diameter higher into the oil shale. Further and regardless, liquid/solid separation or other separation may or may not occur as described above or otherwise. For example, in some embodiments all material falling into subterranean room 14 might be transported therefrom without any separation occurring within subterranean room 14.

In one aspect of the invention, a sub-surface oil shale recovery arrangement for recovering hydrocarbons from oil shale includes a bore hole which extends upwardly from a subterranean room into oil shale. The subterranean room may or may not be received partially or wholly within the oil shale. In other words, the subterranean room in such instance may be entirely received laterally of the oil shale and/or below the oil shale. A heating energy source extends from the subterranean room into the bore hole, and regardless of whether any insulation or cooling as described above is utilized. A liquid-solid separator is received within the subterranean room. By way of example only, separator 58 in the above-described embodiments is but one example liquid-solid separator. A solids collector is also provided in the subterranean room which is fed by the liquid-solid separator. The solids collector comprises an upper volume and a lower volume, wherein the upper and lower volumes are separated by an upper valve and the lower volume comprises a lower valve. By way of example only, the above-described and depicted solids collector 60 is but one example of such solids collector.

Aspects of the invention include methods of recovering hydrocarbons from oil shale utilizing any of the above-described arrangements, and/or other arrangements.

In compliance with the statute, the invention has been described in language more or less specific as to structural and methodical features. It is to be understood, however, that the invention is not limited to the specific features shown and described, since the means herein disclosed comprise preferred forms of putting the invention into effect. The invention is, therefore, claimed in any of its forms or modifications within the proper scope of the appended claims appropriately interpreted in accordance with the doctrine of equivalents.

The invention claimed is:

1. A method of recovering hydrocarbons from oil shale, comprising:

providing a bore hole extending upwardly from a subterranean room into oil shale, at least an upper part of the room being received within the oil shale and comprising a wall through which the bore hole extends, the bore hole comprising a lowest portion within the oil shale and an upper portion within the oil shale;

providing a heating energy source within the bore hole from the subterranean room, the heating energy source extending along the lowest portion and along the upper portion, insulation being received radially about the heating energy source extending along the lowest portion; and applying an effective power to the heating energy source within the bore hole to cause liquid hydrocarbons to be extracted from solids within the oil shale externally of the upper portion of the bore hole, the liquid hydrocarbons entering the bore hole upper portion and flowing downwardly into the bore hole lowest portion about and along the heating energy source and into the subterranean room while applying said effective power to the heating energy source, said insulation received radially about the heating energy source in the lowest portion of the bore hole being sufficient to restrict liquid hydrocarbons from separating from the oil shale at the wall of the subterranean room upon application of effective power; and solids entering the bore hole upper portion with the liquid hydrocarbons and flow downwardly into the bore hole lowest portion about and along the heating energy source and into the subterranean room while applying said effective power to the heating energy source, and further comprising separating said solids entering the bore hole upper portion from the liquid hydrocarbons within the subterranean room by flowing the solids to a solids collector, the solids collector comprising an upper volume and a lower volume, the upper and lower volumes being separated by an upper valve, the lower volume comprising a lower valve, the flowing of solids to the solids collector comprising:

flowing solids to within the lower volume of the solids collector;

flowing solids to within the upper volume of the solids collector while the upper valve is at least partially closed; and while said flowing of solids to within the upper volume while the upper valve is at least partially closed, discharging solids within the lower volume therefrom through the lower valve.

2. The method of claim 1 wherein the insulation contacts the heating energy source.

3. The method of claim 1 wherein the insulation is spaced from the heating energy source.

4. The method of claim 1 wherein the upper portion of the bore hole is void of insulation.

5. The method of claim 1 wherein the lowest portion of the bore hole comprises inner sidewalls defining a fluid conduit through which liquid hydrocarbons flow into the subterranean room and with which the liquid hydrocarbons come into contact during said flow into the subterranean room while applying said effective power to the heating energy source, at least some of the insulation being received more proximate the inner sidewalls as compared to a radial center of the bore hole.

6. The method of claim 5 wherein said at least some of the insulation is received externally of the lowest portion inner sidewalls.

7. The method of claim 5 comprising a lowest bore hole casing defining the lowest portion inner sidewalls, said at least some of the insulation being received externally of the lowest bore hole casing.

8. The method of claim 7 comprising an external casing received about the lowest portion of the bore hole radially outward of the lowest bore hole casing, said at least some of the insulation being received between the lowest bore hole casing and the external casing.

9. The method of claim 8 wherein the upper portion of the bore hole is void of insulation, and the upper portion of the bore hole comprises an upper bore hole casing defining upper portion inner sidewalls with which the liquid hydrocarbons come into contact during said flow into the subterranean room, the upper portion of the bore hole being void of any external casing received radially outward of the upper bore hole casing.

10. The method of claim 1 wherein the lowest portion of the bore hole comprises inner sidewalls defining a fluid conduit through which liquid hydrocarbons flow into the subterranean room while applying said effective power to the heating energy source and with which the liquid hydrocarbons come into contact during said flow into the subterranean room while applying said effective power to the heating energy source, at least some of the insulation being spaced radially inward from the inner sidewalls.

11. The method of claim 10 wherein said at least some of the insulation is received more proximate a radial center of the bore hole than the bore hole inner sidewalls.

12. The method of claim 11 wherein said at least some of the insulation contacts the heating energy source.

13. The method of claim 1 wherein the lowest portion of the bore hole comprises inner sidewalls defining a fluid conduit through which the liquid hydrocarbons flow into the subterranean room while applying said effective power to the heating energy source and with which the liquid hydrocarbons come into contact during said flow into the subterranean room while applying said effective power to the heating energy source, and further comprising a lowest bore hole casing defining the lowest portion inner sidewalls and an external casing received about the lowest portion of the bore hole radially outward of the lowest bore hole casing;

a first portion of the insulation being received between the lowest bore hole casing and the external casing; and a second portion of the insulation being received about the heating energy source radially inward of the inner sidewalls.

14. The method of claim 13 wherein the second portion contacts the heating energy source.

15. The method of claim 1 wherein only a part of the subterranean room is received within oil shale.

16. The method of claim 1 wherein all of the subterranean room is received within oil shale.

17. The method of claim 1 wherein the wall comprises a roof of the subterranean room.

18. A method of recovering hydrocarbons from oil shale, comprising:

providing a bore hole extending upwardly from a subterranean room into oil shale, at least an upper part of the room being received within the oil shale and comprising a wall through which the bore hole extends, the bore hole comprising a lowest portion within the oil shale and an upper portion within the oil shale;

providing a heating energy source within the bore hole from the subterranean room, the heating energy source extending along the lowest portion and along the upper portion, insulation being received radially about the heating energy source extending along the lowest portion;

applying an effective power to the heating energy source within the bore hole to cause liquid hydrocarbons to be extracted from solids within the oil shale externally of the upper portion of the bore hole, the liquid hydrocarbons entering the bore hole upper portion and flowing downwardly into the bore hole lowest portion about and along the heating energy source and into the subterranean room while applying said effective power to the heating energy source, said insulation received radially about the heating energy source in the lowest portion of the bore hole being sufficient to restrict liquid hydrocarbons from separating from the oil shale at the wall of the subterranean room upon application of said effective power; and solids entering the bore hole upper portion with the liquid hydrocarbons and flow downwardly into the bore hole lowest portion about and along the heating energy source and into the subterranean room while applying said effective power to the heating energy source, and further comprising separating said solids entering the bore hole upper portion from the liquid hydrocarbons within the subterranean room by flowing the solids to a solids collector, the solids collector comprising an upper volume and a lower volume, the upper and lower volumes being separated by an upper valve, the lower volume comprising a lower valve, the flowing of solids to the solids collector comprising:

while the upper valve is open and the lower valve is closed, flowing solids to within the lower volume of the solids collector;

closing the upper valve;

while the upper valve is closed, flowing solids to within the upper volume of the solids collector;

opening the lower valve while flowing solids to within the upper volume of the solids collector while the upper valve is closed; and while the lower valve is opened and while the upper valve is closed and while flowing solids to within the upper volume of the solids collector, discharging solids within the lower volume therefrom through the lower valve.

19. A method of recovering hydrocarbons from oil shale, comprising:

providing a bore hole extending upwardly from a subterranean room into oil shale, at least an upper part of the room being received within the oil shale and comprising a wall through which the bore hole extends, the bore hole comprising a lowest portion within the oil shale and an upper portion within the oil shale;

providing a heating energy source within the bore hole from the subterranean room, the heating energy source extending along the lowest portion and along the upper portion;

providing a cooling energy source from the subterranean room radially about the heating energy source extending along the lowest portion;

applying an effective power to the heating energy source within the bore hole to cause liquid hydrocarbons to be extracted from solids within the oil shale externally of the upper portion of the bore hole, the liquid hydrocarbons entering the bore hole upper portion and flowing downwardly into the bore hole lowest portion about and along the heating energy source and into the subterranean room; and while applying said effective power to the heating energy source, applying an effective power to the cooling energy source in the lowest portion of the bore hole to restrict liquid hydrocarbons from separating from the oil shale at the wall of the subterranean room from application of said effective power to the heating source.

20. The method of claim 19 wherein the cooling energy source is received more proximate sidewalls of the lowest portion of the bore hole than a radial center of the lowest portion of the bore hole.

21. The method of claim 19 wherein the cooling energy source comprises closed-loop cooling conduits comprising cooling fluid.

22. The method of claim 21 wherein the cooling conduits are received more proximate sidewalls of the lowest portion of the bore hole than a radial center of the lowest portion of the bore hole.

23. The method of claim 19 comprising insulation received about the heating energy source in the bore hole lowest portion radially inward of the cooling energy source.

24. The method of claim 19 wherein the cooling energy source is received externally of the bore hole to be spaced from contacting said liquid hydrocarbons flowing downwardly within the bore hole lowest portion.

25. The method of claim 19 wherein solids enter the bore hole upper portion with the liquid hydrocarbons and flow downwardly into the bore hole lowest portion about and along the heating energy source and into the subterranean room, and further comprising separating said solids entering the bore hole upper portion from the liquid hydrocarbons within the subterranean room.

26. The method of claim 25 comprising separating said solids entering the bore hole upper portion from the liquid hydrocarbons within the subterranean room by flowing the solids to a solids collector, the solids collector comprising an upper volume and a lower volume, the upper and lower volumes being separated by an upper valve, the lower volume comprising a lower valve, the flowing of solids to the solids collector comprising:

collecting a volume of solids within the lower volume of the solids collector;

collecting a volume of solids within the upper volume of the solids collector with the upper valve at least partially closed; and while said collecting a volume of solids within the upper volume with the upper valve at least partially closed, discharging the volume of solids within the lower volume therefrom through the lower valve.

27. The method of claim 25 comprising separating said solids entering the bore hole upper portion from the liquid hydrocarbons within the subterranean room by flowing the solids to a solids collector, the solids collector comprising an upper volume and a lower volume, the upper and lower volumes being separated by an upper valve, the lower volume comprising a lower valve, the flowing of solids to the solids collector comprising:

with the upper valve open and the lower valve closed, collecting a volume of solids within the lower volume of the solids collector;

closing the upper valve;

with the upper valve closed, collecting a volume of solids within the upper volume of the solids collector;

opening the lower valve; and with the lower valve opened and with the upper valve closed, discharging the volume of solids within the lower volume therefrom through the lower valve.

28. A method of recovering hydrocarbons from oil shale, comprising:

providing a bore hole extending upwardly from a subterranean room into oil shale;

providing a heating energy source within the bore hole from the subterranean room;

applying an effective power to the heating energy source within the bore hole to cause liquid hydrocarbons to be extracted from solids within the oil shale externally of the bore hole, the liquid hydrocarbons along with solids from the oil shale entering the bore hole and flowing downwardly along the heating energy source and into the subterranean room; and within the subterranean room, separating the liquid hydrocarbons from the solids by flowing the solids to a solids collector, the solids collector comprising an upper volume and a lower volume, the upper and lower volumes being separated by an upper valve, the lower volume comprising a lower valve, the flowing of solids to the solids collector comprising:

flowing solids to within the lower volume of the solids collector;

flowing solids to within the upper volume of the solids collector while the upper valve is at least partially closed; and while said flowing of solids to within the upper volume while the upper valve is at least partially closed, discharging solids within the lower volume therefrom through the lower valve.

29. The method of claim 28 wherein the flowing of the solids to the solids collector is along a downwardly angled screen through which the liquid hydrocarbons flow.

30. A method of recovering hydrocarbons from oil shale, comprising:

providing a bore hole extending upwardly from a subterranean room into oil shale;

providing a heating energy source within the bore hole from the subterranean room;

applying an effective power to the heating energy source within the bore hole to cause liquid hydrocarbons to be extracted from solids within the oil shale externally of the bore hole, the liquid hydrocarbons along with solids from the oil shale entering the bore hole and flowing downwardly along the heating energy source and into the subterranean room; and within the subterranean room, separating the liquid hydrocarbons from the solids by flowing the solids to a solids collector along a downwardly angled screen through which the liquid hydrocarbons flow, the heating energy source extending upwardly through the downwardly angled screen and into the bore hole, the solids collector comprising an upper volume and a lower volume, the upper and lower volumes being separated by an upper valve, the lower volume comprising a lower valve, the flowing of solids to the solids collector comprising:

collecting a volume of solids within the lower volume of the solids collector;

collecting a volume of solids within the upper volume of the solids collector with the upper valve at least partially closed; and while said collecting a volume of solids within the upper volume with the upper valve at least partially closed, discharging the volume of solids within the lower volume therefrom through the lower valve.

31. A method of recovering hydrocarbons from oil shale, comprising:

providing a bore hole extending upwardly from a subterranean room into oil shale;

providing a heating energy source within the bore hole from the subterranean room;

applying an effective power to the heating energy source within the bore hole to cause liquid hydrocarbons to be extracted from solids within the oil shale externally of the bore hole, the liquid hydrocarbons along with solids from the oil shale entering the bore hole and flowing downwardly along the heating energy source and into the subterranean room; and within the subterranean room, separating the liquid hydrocarbons from the solids by flowing the solids to a solids collector, the solids collector comprising an upper volume and a lower volume, the upper and lower volumes being separated by an upper valve, the lower volume comprising a lower valve, the flowing of solids to the solids collector comprising:

while the upper valve is open and the lower valve is closed, flowing solids to within the lower volume of the solids collector;

closing the upper valve;

while the upper valve is closed, flowing solids to within the upper volume of the solids collector;

opening the lower valve while flowing solids to within the upper volume of the solids collector while the upper valve is closed; and while the lower valve is opened and while the upper valve is closed and while flowing solids to within the upper volume of the solids collector, discharging solids within the lower volume therefrom through the lower valve.

32. The method of claim 31 wherein the flowing of the solids to the solids collector is along a downwardly angled screen through which the liquid hydrocarbons flow.

33. A method of recovering hydrocarbons from oil shale, comprising:

providing a bore hole extending upwardly from a subterranean room into oil shale;

providing a heating energy source within the bore hole from the subterranean room;

applying an effective power to the heating energy source within the bore hole to cause liquid hydrocarbons to be extracted from solids within the oil shale externally of the bore hole, the liquid hydrocarbons along with solids from the oil shale entering the bore hole and flowing downwardly along the heating energy source and into the subterranean room; and within the subterranean room, separating the liquid hydrocarbons from the solids by flowing the solids to a solids collector along a downwardly angled screen through which the liquid hydrocarbons flow, the heating energy source extending upwardly through the downwardly angled screen and into the bore hole, the solids collector comprising an upper volume and a lower volume, the upper and lower volumes being separated by an upper valve, the lower volume comprising a lower valve, the flowing of solids to the solids collector comprising:

with the upper valve open and the lower valve closed, collecting a volume of solids within the lower volume of the solids collector;

closing the upper valve;

with the upper valve closed, collecting a volume of solids within the upper volume of the solids collector;

opening the lower valve; and with the lower valve opened and with the upper valve closed, discharging the volume of solids within the lower volume therefrom through the lower valve.

34. A sub-surface oil shale recovery arrangement for recovering hydrocarbons from oil shale, comprising:

a bore hole extending upwardly from a subterranean room into oil shale, at least an upper part of the room being received within the oil shale and comprising a wall through which the bore hole extends, the bore hole comprising a lowest portion within the oil shale and an upper portion within the oil shale;

a heating energy source extending from the subterranean room into the bore hole, the heating energy source extending along the lowest portion and along the upper portion, insulation being received radially about the heating energy source extending along the lowest portion; and a cooling energy source extending from the subterranean room that is received radially about the heating energy source extending along the lowest portion.

* * * * *